US005647332A

United States Patent [19]

Hyodo et al.

[11] Patent Number: 5,647,332

[45] Date of Patent: Jul. 15, 1997

[54] FUEL-VAPOR EMISSION-CONTROL SYSTEM FOR CONTROLLING THE AMOUNT OF FLOW THROUGH A CHARCOAL CANISTER

[75] Inventors: Yoshihiko Hyodo; Hiroki Matsuoka, both of Susono, Japan

[73] Assignee: Toyota Jidosha Kabushiki Kaisha, Aichi, Japan

[21] Appl. No.: 601,391

[22] Filed: Feb. 14, 1996

[30] Foreign Application Priority Data

Feb. 21, 1995 [JP] Japan ..... 7-032479

[51] Int. Cl.[6] ..... F02M 25/08

[52] U.S. Cl. ..... 123/519; 123/520

[58] Field of Search ..... 123/516, 518, 123/519, 520

[56] References Cited

U.S. PATENT DOCUMENTS

| | | | |
|---|---|---|---|
| 5,295,472 | 3/1994 | Otsuka et al. | 123/520 |
| 5,359,978 | 11/1994 | Kidokoro et al. | 123/520 |
| 5,460,142 | 10/1995 | Denz et al. | 123/520 |
| 5,460,143 | 10/1995 | Narita | 123/520 |
| 5,474,047 | 12/1995 | Cochard et al. | 123/520 |
| 5,501,198 | 3/1996 | Koyama | 123/520 |
| 5,505,182 | 4/1996 | Denz et al. | 123/520 |

FOREIGN PATENT DOCUMENTS

| | | |
|---|---|---|
| 1-159455A | 6/1989 | Japan . |
| 5-33734A | 2/1993 | Japan . |
| 5-240119A | 9/1993 | Japan . |
| 6-81722A | 3/1994 | Japan . |
| 6-74107A | 3/1994 | Japan . |

*Primary Examiner*—Thomas N. Moulis
*Attorney, Agent, or Firm*—Kenyon & Kenyon

[57] ABSTRACT

The amount of flow in a canister is controlled, in a fuel-vapor emission-control system, in response to the operating condition of an engine, control being performed of the size of a release port on the canister responsive to the amount of purge, thereby enabling a large purging amount. An electromagnetic valve capable of changing the surface area of the port is provided at the atmospheric side of a port of the canister. The degree of opening of this electromagnetic valve is varied, depending on the conditions of refueling, traveling, and parking, and during a purge, the opening of the electromagnetic valve when the amount of purge is large is made larger then when the amount of purge is small. By doing this, the recovery of hydrocarbons from the canister when purging is done is speed up, thus improving the working capacity of the canister.

6 Claims, 6 Drawing Sheets

FUEL-VAPOR EMISSION-CONTROL SYSTEM FOR CONTROLLING THE AMOUNT OF FLOW THROUGH A CHARCOAL CANISTER

BACKGROUND OF THE INVENTION

1. Field of the Invention

The present invention relates to a fuel-vapor emission-control system for an internal combustion engine, and more specifically to a fuel-vapor emission control system for an internal combustion engine which is capable of proper adsorption of vaporized fuel within a charcoal canister and purging of vaporized fuel from the canister to the intake system of the engine, without regard to the amount of fuel vaporized from the fuel tank of the vehicle.

2. Description of the Related Art

In general, in an internal combustion engine, a fuel-vapor emission control system is provided so that fuel does not escape into the atmosphere from the fuel tank, carburetor or other places where fuel is accumulated when the engine is stopped. This fuel-vapor emission-control system causes vapor (a gas mixture of fuel vapor and air) which flows from parts in which fuel is accumulated to be adsorbed in a canister, air being released into the atmosphere and the fuel vapor which is adsorbed in the canister being purged, using the negative pressure at the intake side of the engine while running. In such a canister, to prevent the escape of fuel vapor into the atmosphere when the vehicle is stopped, due to vapor concentration dispersion caused by the temperature difference after running the vehicle, the canister is generally provided with a diaphragm on the atmospheric release port. In addition, in a split canister having a main canister and a sub-canister, there is generally a diaphragm in the path therebetween.

However, when vaporized fuel which has been adsorbed in a canister is purged to the intake manifold of the engine, there are cases in which it is possible, depending upon the operating conditions, to have a large amount of purging. Even if a large amount of purging is done, however, it is not possible to achieve a sufficient flow of air passing through the canister because of the diaphragm. A problem arises in a case such as this in that, because the amount of fuel adsorbed in the canister tends not to be reduced, the working capacity of the canister drops.

SUMMARY OF THE INVENTION

In view of the above-noted problem, an object of the present invention is to provide a fuel-vapor emission-control system for an internal combustion engine in which, by controlling the aperture surface area of the atmospheric release port in the canister when purging, the path to the atmosphere is normally restricted, and when a large amount of purging is required it is possible to achieve the required amount of airflow.

According to one aspect of the present invention, a canister flow control device is provided in a fuel-vapor emission-control system for an internal combustion engine, having a canister which is provided to prevent, by adsorption, the release into the atmosphere of fuel-vapor generated in the fuel tank, and which purges fuel-vapor which has been adsorbed within the canister to an intake manifold at a prescribed running time, this canister amount of flow control device having an atmospheric release port surface area control means which is provided midway in the atmospheric port of the canister which leads to the atmosphere and which is capable of changing the surface area of an atmospheric release port, an internal combustion engine operating condition judgment means which detects the conditions of fuel supply, purge execution, running and parking of the vehicle to judge the operating condition of the vehicle, a canister flow amount storage means for each operating condition of the internal combustion engine, into which is stored the vapor flow amount which is measured beforehand for each operating condition of the internal combustion engine, a canister flow amount calculation means for each operating condition of the internal combustion engine, which calculates the amount of vapor flowing through the canister from the values stored in the canister flow amount storage means for the operating condition of the internal combustion engine which has been determined, a degree of opening calculation means for the atmospheric release port surface area control valve, which calculates the degree of opening of the atmospheric release port surface area control valve in accordance with the calculated amount of vapor flow, and a degree of opening control means for the atmospheric release surface area control valve, which controls the degree of opening of the atmospheric release port surface area control valve, in accordance with the calculated degree of opening.

A duty cycle controlled electrical purge flow control valve can be used as the atmospheric release port surface area control valve. A buffer canister with a small working capacity can be connected to the atmosphere side of the atmospheric release port surface area control valve.

In addition, a purge flow amount detection means, which detects the amount of purge flow when the internal combustion engine is in the purging condition, can be provided on the canister flow amount control device, the degree of opening calculation means for the atmospheric release port surface area control valve making the degree of opening large when the amount of purging is large with the engine in the purging condition, compared to the condition in which the amount of purging is small.

In a fuel-vapor emission-control system according to the present invention, when purging vaporized fuel which has been adsorbed in the canister to the intake system of the internal combustion engine, when the mount of purging increases, the atmospheric release surface area changing means provided in the canister makes the atmospheric release surface area large. As a result, the amount of vaporized fuel released from the canister becomes large, providing a large amount of purging, thereby enabling the vaporized fuel adsorbed in the canister to be reduced in a short period of time.

In this manner, by optimally controlling the opening of the port at the atmospheric release side of the canister by controlling the degree of opening of an electromagnetic valve, when a large purge is performed it is possible to achieve the large amount of air required for the large purge, and because it is possible to reduce the amount of vaporized fuel adsorbed in the canister in a short period of time, the amount of time to recover the vaporized fuel adsorbed in the canister is shortened, thereby improving the working capacity of the canister.

BRIEF DESCRIPTION OF THE DRAWINGS

The present invention will be more clearly understood from the description as set forth below, with reference being made to the accompanying drawings, wherein.

DESCRIPTION OF THE PREFERRED EMBODIMENT

Figure 1A:
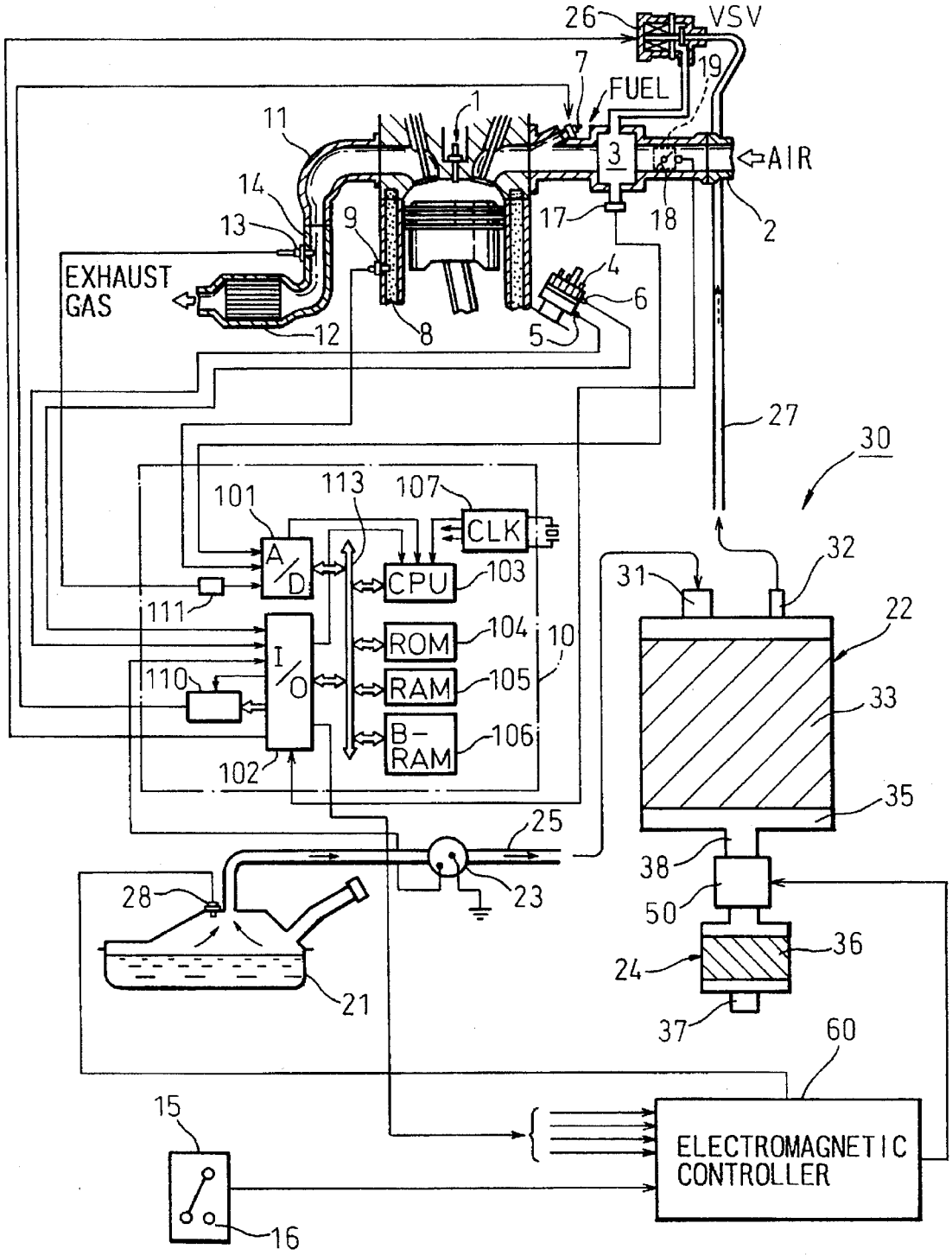
FIG. 1A is an overall drawing which shows the configuration of an embodiment of fuel-vapor emission-control system for an internal combustion engine according to the present invention, along with the internal combustion engine.

An embodiment of the present invention will be described below, with reference to the accompanying drawings.

FIG. 1 shows the configuration of an embodiment of the present invention. This drawing shows, in simplified form, an electronically controlled internal combustion engine 1 which is provided with a fuel-vapor emission-control system 30.

In FIG. 1, the reference numeral 1 denotes an internal combustion engine, 2 is an intake manifold, 3 is a surge tank, 4 is a distributor, 5 and 6 are crank angle sensors, 7 is a fuel injection valve, 8 is a cooling water path, 9 is a water temperature sensor, 10 is a control circuit, 11 is an exhaust manifold, 12 is a catalytic converter, 13 is an $O_2$ sensor, 14 is an exhaust pipe, 17 is a pressure sensor, 18 is a throttle valve, and 19 is a throttle degree of opening sensor.

The throttle valve 18 is provided in the intake manifold 2 of the internal combustion engine 1. The throttle degree of opening sensor 19, which detects the degree of opening of the throttle valve 18, is provided on the shaft of the throttle valve 18, the surge tank 3 is provided in the manifold downstream from the throttle degree of opening sensor 19, and the pressure sensor 17, which detects the intake pressure, is provided within the surge tank 3. The fuel injection valve 7, for the purpose of supplying pressurized fuel from the fuel supply system to the intake port of each cylinder, is provided downstream from the surge tank 3.

The distributor 4 is provided with a crank angle sensor 5, which generates a reference position detection pulse signal at each, for example, 720° of crank angle (CA) movement, and a crank angle sensor 6, which generates a reference position detection pulse signal at each 30° of crank angle (CA) movement. The pulse signals from these crank angle sensors 5, 6 serve as, for example, the fuel injection timing interrupt request signal, the spark timing reference timing signal, and fuel injection amount calculation control interrupt request signal. These signals are supplied to an input/output interface 102 of the control circuit 10, and of these signals, the output of the crank angle sensor 6 is supplied to an interrupt terminal of a CPU 103.

The water temperature sensor 9 for the purpose of detecting the temperature of the cooling water is provided in the cooling water path 8 of the cylinder block of the internal combustion engine 1, and generates an analog voltage electrical signal responsive to the temperature of the cooling water, THW. This output is supplied to an A/D converter 101 of the control circuit 10.

The three-way catalytic converter 12, which cleanses three harmful components of the exhaust gas, vaporized fuel, CO, and NOx, is provided in the exhaust system, downstream from the exhaust manifold 11. Downstream from the exhaust manifold 11, on the exhaust pipe 14 downstream from the catalytic converter 12, is provided the $O_2$ sensor 13, which is a type of air-fuel ratio sensor. The $O_2$ sensor 13 generates an electrical signal which is responsive to the concentration of oxygen in the exhaust gas. That is, the $O_2$ sensor 13 supplies, via a signal processing circuit 111 of the control circuit 10, voltages which differ, responsive to the rich condition and the lean condition of air-fuel ratio with respect to the theoretical air-fuel ratio. The input/output interface 102 is supplied with an on/off signal of a key switch (not shown in the drawing).

The control circuit 10 is implemented by, for example, a microcomputer and, in addition to the above-noted A/D converter 101, an input/output interface 102, a CPU 103, and a signal processing circuit 111, is provided with a ROM 104, a RAM 105, a buffer RAM 106 which holds information even after the key switch is set to off, a clock (CLK) 107, and so on, these being commonly connected via a bus 113. In this control circuit 10, an injection control circuit 110, which includes a down-counter, and up-counter, and a drive circuit, is provided for the purpose of controlling the fuel injection valve 7.

The fuel-vapor emission-control system 30, which prevents the escape of vaporized fuel from the fuel tank 21 to the atmosphere, has a charcoal canister 22 and an electrical purge flow amount control valve (VSV) 26. The charcoal canister 22 is joined to the bottom of the fuel tank 21 by means of a vapor delivery pipe 25, and adsorbs vapor generated from the fuel tank 21. This vapor delivery pipe 25 has, midway in it, a tank internal pressure control valve 23 which opens when the vapor pressure within the fuel tank 21 exceeds a prescribed pressure. This internal pressure control valve 23 has mounted on it a switch, the open/closed state of this internal pressure control value 23 being input to the input/output interface 102. The VSV 26 is an electromagnetic valve which is provided midway in the vapor return pipe 27, which returns vapor adsorbed in the charcoal canister 22 to the downstream side of the throttle valve 18 of the intake manifold 2, this valve opening and closing in response to an electrical signal from the control circuit 10. This VSV 26 can provide duty-cycle control of the amount of vapor flowing into the intake manifold 2.

In this embodiment, the canister 22 has a tank port 31 which connects to the vapor delivery pipe 25, a purge port 32 which connects to the vapor return pipe 27, activated charcoal 33 which adsorbs vapor, and an atmospheric port 38 having a large cross-sectional area. An atmospheric chamber 35 is formed between the atmospheric port 38 and the activated charcoal 33.

Additionally, in this embodiment, at the end of the atmospheric port 38, is mounted an electromagnetic valve 50 for control of the amount of flow, the atmospheric side of this electromagnetic valve 50 being connected to a buffer canister 24. Activated charcoal 36 is provided inside the buffer canister 24 as well, a second atmospheric port 37, having a large cross-sectional area, being provided at the atmospheric release side thereof.

The electromagnetic valve 50 is configured so that it is able to adjust the amount of air flowing through the atmospheric port 38, by means of the degree of opening of a valve located therein. It is possible to use a known duty-cycle controlled VSV, linear solenoid valve, or rotary valve or the like as this electromagnetic valve 50.

Figure 1B:
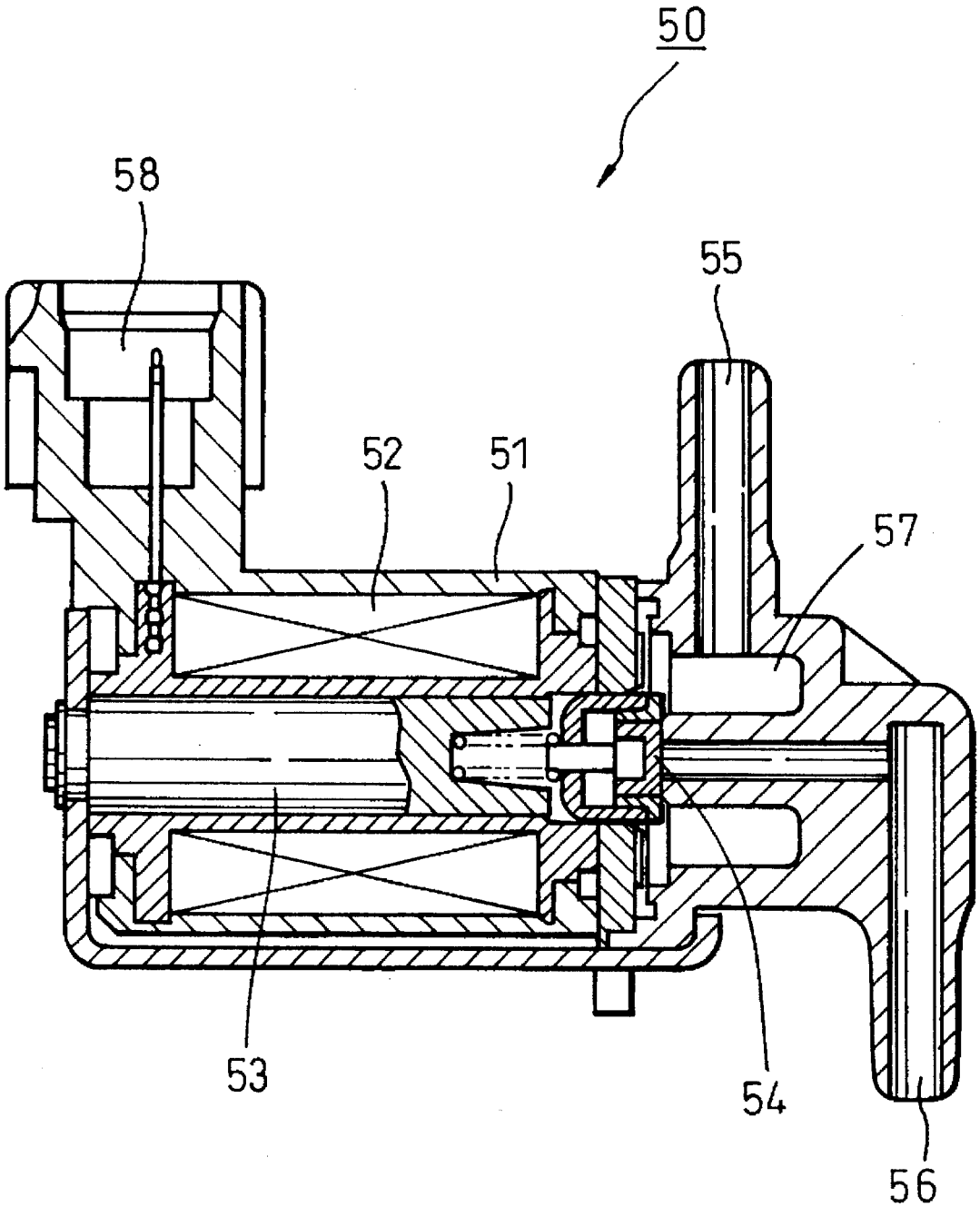
FIG. 1B is a cross-sectional view which shows the configuration of an example of an electromagnetic valve of FIG. 1A.

FIG. 1B shows an example of the configuration in the case in which the electromagnetic valve 50 is a duty-cycle controlled VSV. Inside housing 51 of the electromagnetic valve 50 is provided a coil 52, inside which is provided a plunger 53, which is driven by this coil 52. The coil 52 is electrically connected to a connector 58 which is provided on one end of the housing 51, the plunger 53 moving in response to the duty cycle of the control signal input to this connector 58. On the end part of this plunger 53 is mounted a valve 54, the opening of the internal path 57 of which is changed by means of the movement of the plunger 53. The internal path 57 is connected by means of port 55 to the canister 22 which is shown in FIG. 1A, and is further connected by means of port 56 to the buffer canister 24 which is shown in FIG. 1A.

The degree of opening of this electromagnetic valve 50 is controlled by a control signal from an electromagnetic valve controller 60. The electromagnetic valve controller 60 has within it (not shown in the drawing) a microcomputer having a configuration similar to the above-described control circuit 10. The electromagnetic valve controller 60 has input to it a pressure detection signal from the internal pressure sensor 28 provided in the fuel tank 21, a refueling signal from a refueling detection switch 16 provided on a lid opener 15, and signals such as intake air temperature signal, running time signal, and ignition switch signal from the control circuit 10. For this reason, signals from an igniter (not shown in the drawing) and an intake air temperature sensor are input to the control circuit 10.

In the configuration described above, when the key switch (not shown in the drawing) is set to on, the control circuit 10 is energized and a program is started, whereupon outputs from various sensors are captured, and the fuel injection valve 7 and other actuators are controlled. In addition, the control circuit 10 sends the required information to the electromagnetic valve controller 60.

Next, the operation of the fuel-vapor emission-control system 30 configuration as described in the above-noted embodiment will be described.

Figure 2:
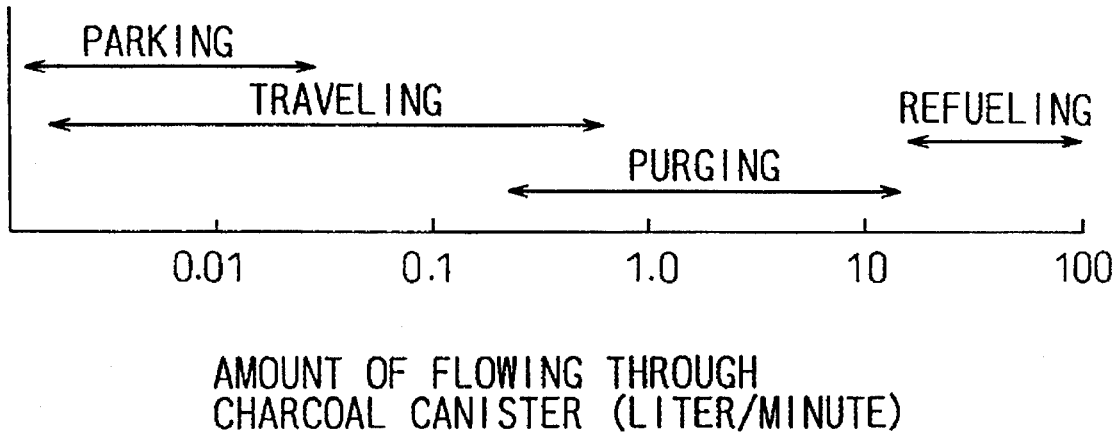
FIG. 2 is a drawing which illustrates the relationship between the vehicle operating condition and the amount of canister flow.

FIG. 2 shows the amount of vapor flowing within the canister 22 for various vehicle operating conditions. As can be seen from FIG. 2, the maximum amount of vapor flow in the canister 22 is during refueling, followed by the condition of purging, with the amount of vapor flow during traveling and parking being small. Therefore, from the amount of canister flow shown in FIG. 2, is can be seen that is better to make the opening of the electromagnetic valve 50 large during purging.

Figure 3:
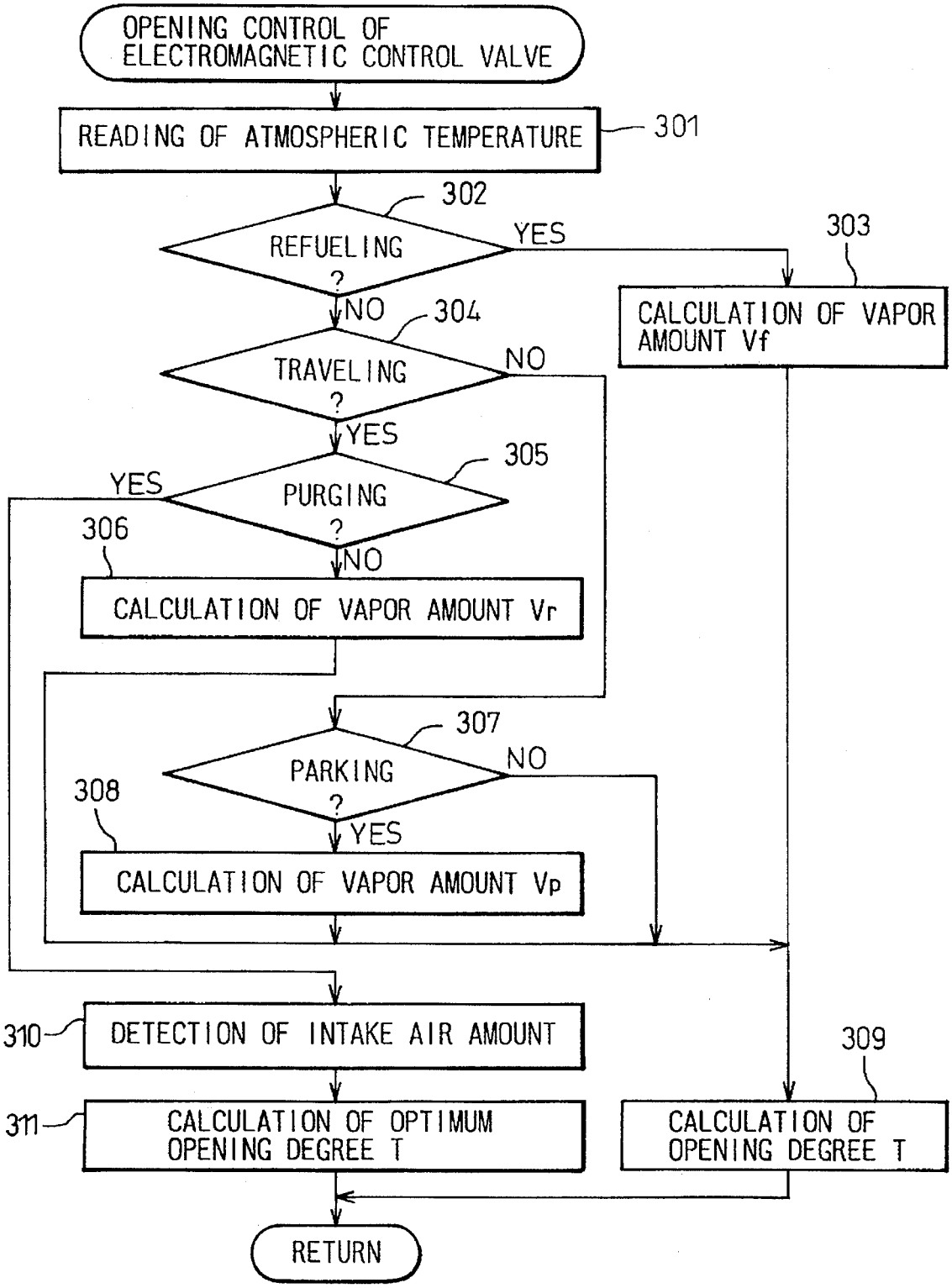
FIG. 3 is a flowchart which shows an example of the control procedure for the degree of opening of the electromagnetic valve in the fuel-vapor emission-control system for an internal combustion engine shown in FIG. 1A.

FIG. 3 is a flowchart which shows an example of the procedure whereby the degree of opening of the electromagnetic valve 50 is controlled by the electromagnetic valve controller 60.

First, at step 301, the electromagnetic valve controller 60 reads in the air temperature t which is input from the control circuit 10. In subsequent steps, the electromagnetic valve controller 60 calculates the degree of opening of the electromagnetic valve 50 for the following four cases.

(1) Vehicle being refueled (2) Vehicle traveling (3) Vehicle parked (4) Purging while vehicle is traveling In view of these four conditions, the procedure for control of the degree of opening of the electromagnetic valve 50 will be described separately for the four conditions.

(1) Calculation of Degree of Opening During Refueling

The judgment as to whether or not the vehicle is being refueled is made at step 302 by the presence or lack of a refueling signal from the refueling detection switch 16. Specifically, in the case in which the refueling detection switch 16, which is provided on the lid opener 15 for the purpose of opening the lid of the fuel tank 21, is on, the refueling signal is input to the electromagnetic valve controller 60, this controller then judging that the vehicle is being refueled.

Figure 4A:
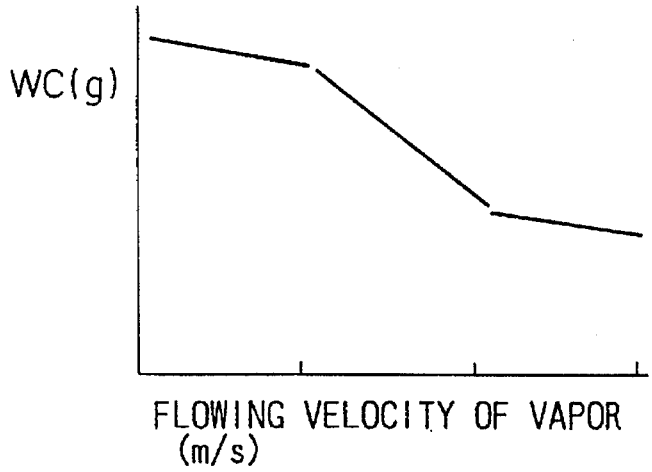
FIG. 4A is a graph which shows the relationship of the velocity of flow of vapor in the canister to the working capacity of the canister.
Figure 4B:
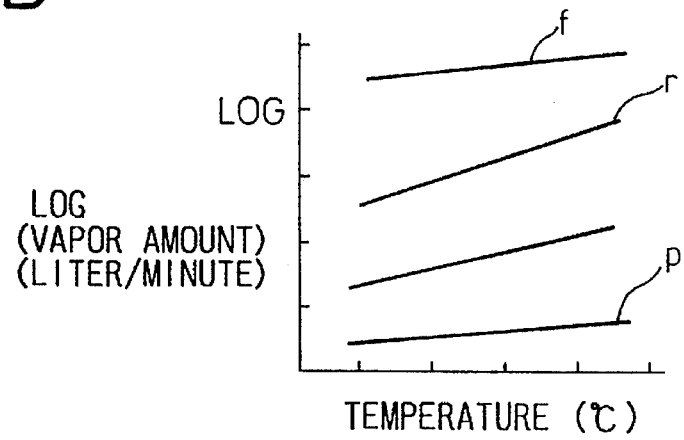
FIG. 4B is a graph which shows the relationship between the air temperature and the amount of vapor flow.

Then, in the case in which the judgment is made that the vehicle is being refueled, control proceeds to step 302, at which a calculation of the amount of vapor Vf fuel during refueling is performed. The calculation of the amount of vapor Vf is performed using the characteristics indicated by the symbol f (during refueling) in FIG. 4B, which shows the air temperature versus amount of vapor characteristics with the vehicle operation condition as a parameter. The plot of the air temperature versus amount of vapor characteristic of FIG. 4B is stored in the form of a map in the electromagnetic valve controller 60. When the intake air temperature signal is input to the electromagnetic valve controller 60 from the control circuit 10, the amount of vapor Vf for this temperature is determined by interpolation of the map of the characteristics shown as curve f in FIG. 4B.

Figure 4C:
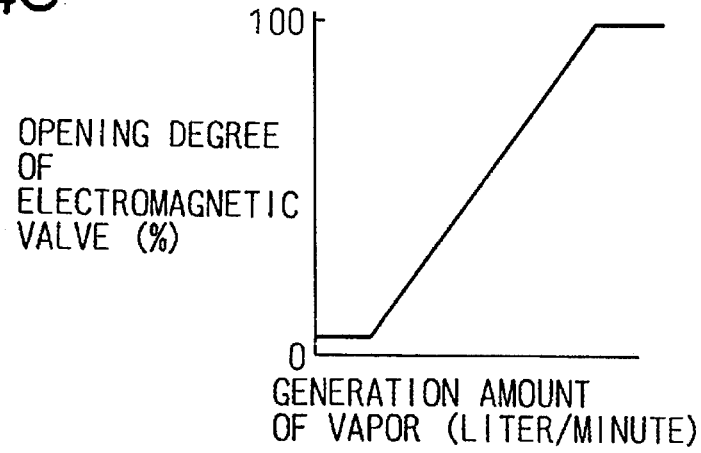
FIG. 4C is a graph which shows the relationship between the amount of vapor generated and the opening degree of the electromagnetic valve.

After the amount of vapor Vf is interpolated for refueling at step 303, control proceeds to step 309. At step 309, the degree of opening T of the electromagnetic valve during refueling is calculated, using the amount of vapor generated versus electromagnetic valve degree of opening characteristics shown in FIG. 4C. The plot of the amount of vapor generated versus electromagnetic valve degree of opening of FIG. 4C is also stored as a map in the electromagnetic valve controller 60. Therefore, at step 309, the degree of opening of the electromagnetic valve during refueling is calculated by the electromagnetic valve controller 60 by interpolation of the map having the characteristics shown in FIG. 4C. By doing this, when the degree of opening T of the electromagnetic valve is determined, this routine is ended.

(2) Calculation of Degree of Opening During Traveling

At step 302, if the judgment is made that the vehicle is not being refueled, at step 304 a judgment is made by the electromagnetic valve controller 60 as to whether or not the vehicle is traveling. In the case in which the judgment is that the vehicle is traveling, control proceeds to step 305, at which a judgment is made as to whether or not a purge is in progress. This judgment as to whether a purge is in progress is made by means of whether or not the VSV 26 is open. In the case in which the vehicle is traveling but a purge is not in progress, control proceeds to step 306, at which the calculation of the amount of vapor Vr during traveling is performed.

The calculation of the amount of vapor Vr during traveling of the vehicle is made in the same manner as described in detail for step 303, by determining the amount by interpolation of a map having the characteristics shown as the curve r (traveling) in the air temperature versus amount of vapor characteristics shown in FIG. 4B with the vehicle operating condition as a parameter. After the amount of vapor Vr during traveling is determined by interpolation calculation at step 306, control proceeds to step 309. At step 309, the degree of opening of the electromagnetic valve 50 during traveling is determined by interpolation of the amount of vapor generation versus electromagnetic valve degree of opening characteristics shown in FIG. 4C. When the degree of opening T of the electromagnetic valve 50 during traveling is thus determined, the routine is ended.

(3) Calculation of Degree of Opening During Parking

When at step 302 the judgment is made that the vehicle is not being refueled, at which point control proceeds to step 304, if judgment is made that the vehicle is not even traveling, control proceeds to step 307, at which a judgment is made as to whether the vehicle is parked. The judgment of whether the vehicle is parked at step 307 is made by the electromagnetic valve controller 60, based on the conditions of not only the vehicle speed being zero, but also the engine being stopped. In the case in which it is judged that the vehicle is parked, control proceeds to step 308, at which point a calculation of the amount of vapor Vp in the parked condition is performed.

The calculation of the amount of vapor Vp during the parked condition is made in the same manner as described in detail with regard to step 303, by interpolating a map having the characteristics shown as the curve p (parked) in the air temperature versus amount of vapor characteristics shown in FIG. 4B with the vehicle operating condition as a parameter. After the amount of vapor Vp in the parked condition is determined by interpolation calculation at step 308. When this calculation of the amount of vapor Vp during the parked condition is made at this step 308, control proceeds to step 309. At step 309, the degree of opening T of the electromagnetic valve 50 is calculated by performing interpolation of the map of the amount of vapor versus electromagnetic valve degree of opening shown in FIG. 4C. When the degree of opening of the electromagnetic valve 50 is thus determined, the routine is ended.

In the case in which, at step 307, it is judged that the vehicle is not in the parked condition, it could be, for example, that the vehicle is stopped with the engine idling. In such cases, control proceeds to step 309 without calculating the amount of vapor, the degree of opening of the electromagnetic valve 50 being calculated based on the air temperature.

(4) Calculation of the Degree of Opening During Purging

If the judgment is made at step 302 that the vehicle is not being refueled, control proceeds to step 304, and at this step if the judgment is made that the vehicle is traveling, a judgment is then made at step 305 as to whether or not a purge is in progress. The judgment at step 305 as to whether or not a purge is in progress is made based on whether or not the VSV 26 is open. If at step 305 it is judged that a purge is in progress, control proceeds to step 310.

At step 310, the intake air amount is read in from the control circuit 10 by the electromagnetic valve controller 60 as a characteristic engine parameter of operation condition of the vehicle. At the next step 311, the optimum degree of opening T of the electromagnetic valve 50 for this amount of air intake is calculated, at which point the routine is ended. The optimum degree of opening T of the electromagnetic valve 50 for the read in amount of air intake during purging can be measured and stored in the electromagnetic valve controller 60 beforehand.

The degree of opening T of the electromagnetic valve 50 during the vehicle conditions of refueling, traveling, and parking can be measured beforehand as the degree of opening of the electromagnetic valve 50 so that the internal pressure in the fuel tank 21 is within a prescribed range, this being stored as a database in a memory within the electromagnetic valve controller 60. It is also possible to determine the amount of vapor with parameters such as fuel temperature and vapor temperature.

By performing control of the degree of opening T of the electromagnetic valve 50 in response to the amount of vapor, as described above, it is possible to perform precise control of the amount of vapor flow, enabling the control of the flow so that the internal pressure in the fuel tank 21 is maximized within the limits imposed by tank strength and fuel supply performance requirements. For this reason, the velocity of the vapor flow in the canister 22 is slowed, thereby improving its working capacity (WC). FIG. 4A shows the relationship between the vapor flow velocity and the working capacity of the canister 22. It can be seen from this drawing that the working capacity increases as the vapor velocity decreases.

Next, the optimum degree of opening T of the electromagnetic valve 50 during purging will be described. The efficiency of purging is judged by means of two factors. This first factor is how much vapor can be separated from the canister for a given amount of air. The other factor is a factor characteristic of engine purging, which is the degree to which the amount of air can be increased for a given negative pressure.

Figure 5A:
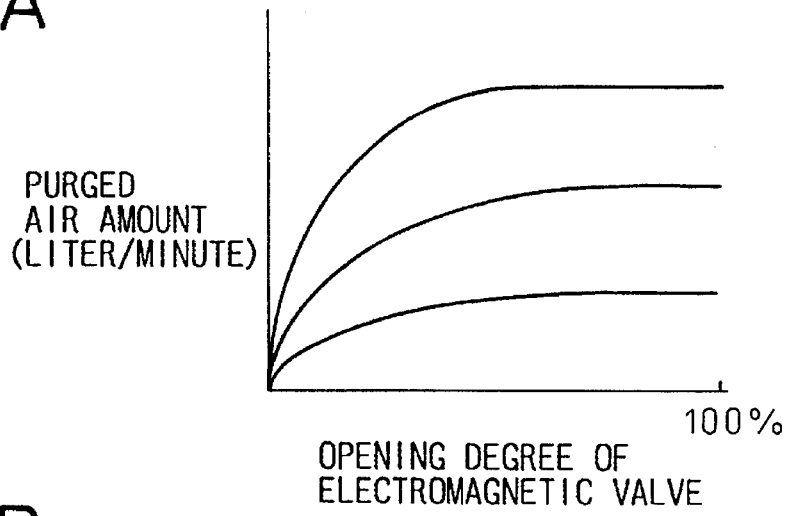
FIG. 5A is a graph which shows the relationship between the degree of opening of the electromagnetic valve and the purged air amount.
Figure 5B:
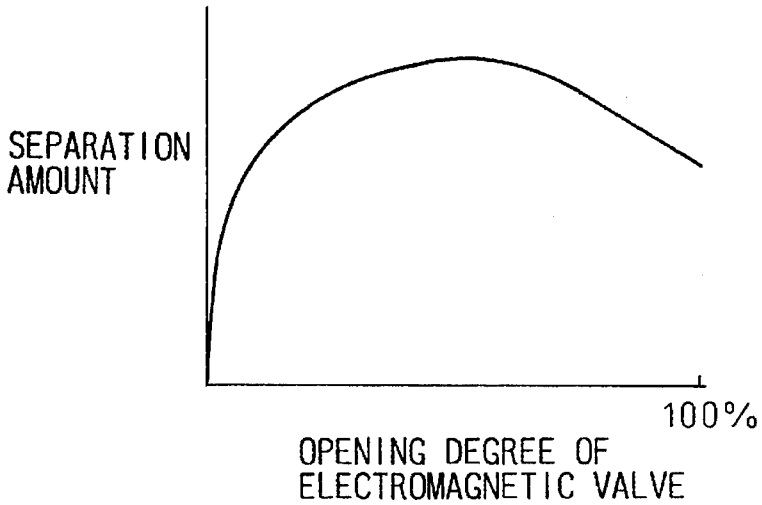
FIG. 5B is a graph which shows the relationship between the degree of opening of the electromagnetic valve and the vapor separation amount.
Figure 5C:
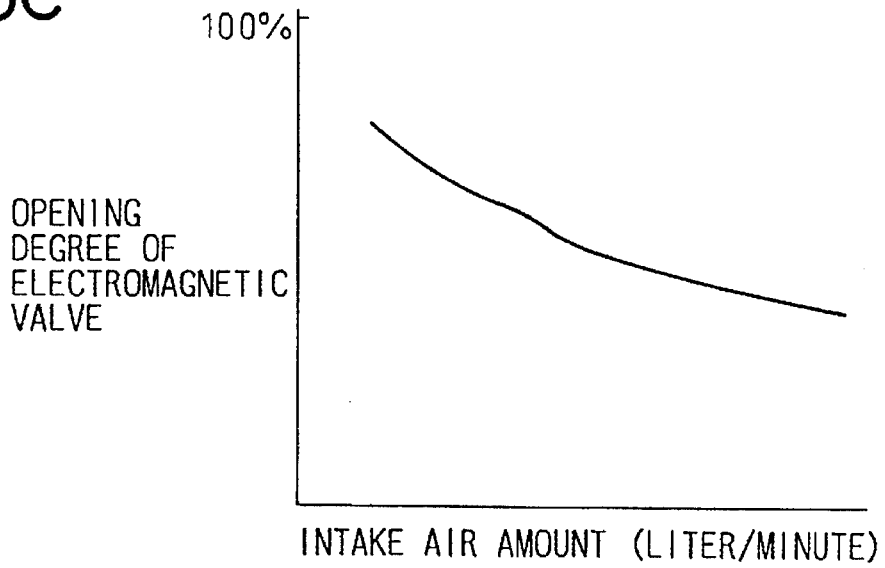
FIG. 5C is a graph which shows the relationship between the intake air amount and the degree of opening of the electromagnetic valve.

The relationship of the degree of opening of the electromagnetic valve 50 to the purging flow amount is shown in FIGS. 5A and 5B. FIG. 5A shows the degree of opening of the electromagnetic valve and the purged air amount with the intake air amount as a variable. FIG. 5B shows the relationship between the degree of opening of the electromagnetic valve and the amount of vaporized fuel separated in the canister 22. As can be seen from FIG. 5A, although when the opening of the electromagnetic valve 50 is maximum the amount of purge air increases but flow resistance in parts other than the electromagnetic valve 50 causes the amount of purge air flow to flatten off after a certain opening is reached. As can be seen from FIG. 5B, when the degree of opening of the electromagnetic valve 50 is small and when the opening is too large, the flow of air does not reach all of the activated charcoal, so that the amount of separation decreases. Therefore, it can be seen that there exists an optimum degree of opening of the electromagnetic valve 50. From the above, it can be seen that the optimum degree of opening of the electromagnetic valve 50 when the amount of intake air is a variable should be made as shown in FIG. 5C. This optimum degree of opening can also be stored in the memory of the electromagnetic valve controller 60 beforehand.

According to the embodiment which is described in detail above, when a purge is performed of vaporized fuel which has been adsorbed in the canister, even if the amount of purging is the maximum, the degree of opening of the electromagnetic valve 56 provided in the canister is controlled properly, providing a large amount of vaporized fuel separation and enabling a large purge amount, while shortening the amount of time for the recovery of vaporized fuel which has been adsorbed in the canister, thereby improving the working capacity thereof.

What is claimed is:

1. A canister amount of flow control device in a fuel-vapor emission control system for an internal combustion engine, having a canister which is provided to prevent, by adsorption, the release into the atmosphere of fuel-vapor generated in a fuel tank, and which purges fuel-vapor which has been adsorbed within said canister to an intake manifold at a prescribed running time, said canister amount flow control device comprising:

an atmospheric release port surface area control valve which is provided in an atmospheric port of said canister which leads to the atmosphere, wherein the atmospheric release port surface area control valve is capable of changing the surface area of said atmospheric release port;

an internal combustion engine operating condition judgment means which detects the conditions of fuel supply, purge execution, running and parking of the vehicle to judge the operating condition of the vehicle;

a canister flow amount storage means for storing, for each operating condition of said internal combustion engine, a vapor flow amount which is measured beforehand;

a canister flow amount calculation means for calculating for each operating condition of the internal combustion engine, an amount of vapor flowing through said canister from the values stored in said canister flow amount storage means for the operating condition of said internal combustion engine which has been determined;

a degree of opening calculation means for calculating the degree of opening of said atmospheric release port surface area control valve based on the amount of fuel vapor flow calculated by said canister flow amount calculation means; and a degree of opening control means for controlling the degree of opening of said atmospheric release port surface area control valve, in accordance with said calculated degree of opening.

2. A canister amount of flow control device according to claim 1, wherein said atmospheric release port surface area control valve is a duty cycle controlled electric purging flow control valve.

3. A canister amount of flow control device according to claim 1, wherein said atmospheric release port surface area control valve has connected to its atmosphere side a buffer canister with a small work capacity.

4. A canister amount of flow control device according to claim 1, further comprising a purge flow detector for detecting a purge flow amount when said internal combustion engine is in the purge condition, wherein said degree of opening calculation means calculates a larger degree of opening of said atmospheric release port surface area control valve large which is larger when the purge amount is large, than it is the purge amount is small.

5. A canister flow control device according to claim 4, wherein said atmospheric release port surface area control valve is a duty cycle controlled electrical purge flow control valve.

6. A canister flow control device according to claim 4, wherein said atmospheric release port surface area control valve has connected to its atmosphere side a buffer canister with a small work capacity.

* * * * *

UNITED STATES PATENT AND TRADEMARK OFFICE

CERTIFICATE OF CORRECTION

PATENT NO. : 5,647,332

DATED : July 15, 1997

INVENTOR(S) : Yoshihiko HYODO, et al.

It is certified that error appears in the above-indentified patent and that said Letters Patent is hereby corrected as shown below:

ABSTRACT, line 14, change "speed" to --speeded--.

Column 2, line 42, change "mount" to --amount--.

Column 5, line 58, change "is" to --occurs--.

Column 5, line 61, change "is" after "FIG. 2" to --it-- and insert --it-- between "that" and "is".

Column 7, line 34, delete "After" and change "the amount" to --The amount --.

Column 10, line 20, delete "large" after "valve".

Column 10, line 21, insert --when-- between "is" and "the".

Signed and Sealed this

Fourteenth Day of April, 1998

Bruce Lehman

*Attest:*

BRUCE LEHMAN

*Attesting Officer*

*Commissioner of Patents and Trademarks*